United States Patent [19]

Galvis

[11] Patent Number: 4,479,611

[45] Date of Patent: Oct. 30, 1984

[54] POP-UP SPRINKLER

[75] Inventor: Oscar Galvis, LaVerne, Calif.

[73] Assignee: Rain Bird Consumer Products Mfg. Corp., Durate, Calif.

[21] Appl. No.: 406,028

[22] Filed: Aug. 6, 1982

[51] Int. Cl.[3] ..... B05B 3/00

[52] U.S. Cl. ..... 239/205

[58] Field of Search ..... 239/206, 205, 204, 203, 239/207, 210, 242, 237, 225; 137/469; 251/332

[56] References Cited

U.S. PATENT DOCUMENTS

| | | | |
|---|---|---|---|
| 3,033,467 | 1/1959 | Hofer | 239/204 |
| 3,088,677 | 7/1961 | Coffey | 239/205 |
| 3,637,134 | 1/1972 | Felix | 239/206 |
| 3,713,584 | 1/1973 | Hunter . | |
| 4,064,906 | 8/1974 | Berg | 137/469 X |
| 4,078,726 | 3/1978 | Walto . | |
| 4,351,477 | 9/1982 | Choi . | |

*Primary Examiner*—John J. Love
*Assistant Examiner*—Kevin Patrick Weldon
*Attorney, Agent, or Firm*—Fulwider, Patton, Rieber, Lee & Utecht

[57] ABSTRACT

A pop-up sprinkler is provided with a control valve for sealing a sprinkler housing against water inflow to prevent leakage or drainage therethrough unless the pressure in a water supply line reaches or exceeds a predetermined level sufficient to move a spring-biased pop-up stem rapidly to an elevated spraying position. The control valve comprises a relatively small valve plug at the bottom of the pop-up stem and encircled by a seal ring for sealing engagement with a valve seat when water pressure is low to close a water inlet at the bottom of the sprinkler housing. In a preferred form wherein the housing is formed by a molding or casting process, the valve seat is defined by the inner diameter surface of an annular flange upstanding from a bottom wall of the housing and having a substantially uniform thickness for solidification with little or no valve seat heat deformation or distortion. When the water pressure increases to the predetermined level, the pressure displaces the valve plug from the valve seat and thereupon acts against the comparatively larger cross-sectional area of the pop-up stem resulting in a comparatively larger force for moving the stem rapidly to the elevated spraying position.

21 Claims, 4 Drawing Figures

POP-UP SPRINKLER

BACKGROUND OF THE INVENTION

This invention relates generally to pop-up sprinklers for use in an irrigation system to water lawns, crops, and the like. More specifically, this invention relates to an improved pop-up sprinkler having a pressure-responsive control valve of simplified construction for sealing the sprinkler against water inflow to prevent leakage or drainage therethrough when water pressure is insufficient to move a pop-up stem rapidly to an elevated spraying position.

Pop-up sprinklers in general are well known in the art to include a spray nozzle carried at the upper end of a pop-up stem or riser which is in turn supported within a sprinkler housing for movement between retracted and elevated position in response to the pressure of water supplied to the sprinkler housing via a water supply line. More particularly, when water pressure is relatively low, such as when the water supply is turned off, the pop-up stem remains typically under the influence of a biasing spring in a position retracted substantially into the sprinkler housing with the spray nozzle disposed substantially flush with the upper end of the sprinkler housing. However, when water pressure is relatively high, such as when the water supply is turned on, the pressurized water acts against the underside of the pop-up stem to move the stem toward a position projecting upwardly from the sprinkler housing with the spray nozzle elevated above the sprinkler housing. In this elevated position, various seal structures cooperating between the stem and the housing confine the water flow to passage through the spray nozzle which is advantageously located above surrounding vegetation for unobstructed discharge of irrigation water.

One disadvantage encountered with pop-up sprinklers in general relates to leakage or drainage of water through the sprinkler when the pop-up stem is in any position other than the elevated spraying position. That is, substantial dimensional clearances are required between the pop-up stem and the sprinkler to accommodate stem movement between the retracted and elevated positions. These clearances, however, unfortunately define leakage paths through which water can flow in bypass relation with the sprinkler housing.

More specifically, during operation of a pop-up sprinkler, water leakage can occur during a relatively slow increase in water pressure, such as when the water supply is turned on slowly or when the water supply line is connected along its length to a relatively large number of sprinklers, whereby the pop-up stem moves relatively slowly from the retracted position to the elevated spraying position. Alternatively, when the water supply is turned off, water remaining in the supply line will drain through one or more pop-up sprinklers located at relatively low elevational positions in an irrigation system. In any event, water leakage or drainage can result in substantial quantities of wasted water which can be highly undesirable, particularly in relatively dry regions having limited water resources. Moreover, the wasted water tends to flood the area immediately surrounding the pop-up sprinkler to result in localized overwatering which can adversely affect plant development and growth.

In the past, various improvements to pop-up sprinklers have been proposed in an effort to reduce water waste from low pressure leakage or drainage through the sprinkler. For example, pop-up stem designs have been suggested wherein the stem has a relatively small cross-sectional area exposed to pressure when the water supply is turned on, thereby requiring a relatively high water pressure to initiate upward movement of the stem toward the elevated spraying position. Once this movement is initiated, a comparatively larger cross-sectional area of the stem is exposed to pressure resulting in a comparatively larger hydraulic force acting upon the stem to move the stem rapidly from the retracted position to the elevated position. While such stem designs advantageously minimize the time required for the stem to move from the retracted position to the elevated position, and thereby minimize leakage during such movement, they have not provided any satisfactory means for preventing water leakage or drainage when the water pressure in insufficient to displace the stem from the retracted position. Accordingly, substantial water leakage or drainage can still occur.

Some pop-up sprinkler stem designs have been proposed further to include a valve member or device for sealing the sprinkler against water inflow when the pop-up stem is in the retracted position. Such proposals, however, have resulted in relatively complex and expensive sprinkler constructions frequently having an undesirably large cross-sectional area of the pop-up stem exposed to water pressure. Accordingly, while leakage is prevented when the stem is in the retracted position, the stem pops up relatively slowly and at a relatively low pressure such that substantial leakage can still occur during movement to the elevated spraying position.

There exists, therefore, a significant need for an improved pop-up sprinkler having a pressure-responsive valve device of simplified, inexpensive construction and a relatively small cross-sectional size for sealing the sprinkler against water inflow until the water pressure reaches a predetermined level sufficient for rapid movement of the pop-up stem to an elevated spraying position. The present invention fulfills this need.

SUMMARY OF THE INVENTION

In accordance with the invention, a pop-up sprinkler includes a control valve of relatively small cross-sectional area carried at the bottom end of a pop-up stem for sealing a water inlet port in the bottom of a sprinkler housing to prevent water flow into the sprinkler when the water pressure is relatively low. The control valve thus seals the sprinkler housing against leakage or drainage of water when the water supply is turned off or when the water supply is turned on but the pressure is less than a predetermined level sufficient to move the pop-up stem rapidly to an elevated spraying position. When the water pressure reaches the predetermined level, the control valve displaces from the inlet port to expose the comparatively larger cross-sectional area of the pop-up stem to the relatively high water pressure resulting in a sudden and substantial increase in the hydraulic force applied to the stem for rapid motion of the stem to the elevated spraying position.

In a preferred form of the invention, the control valve comprises a relatively small cylindrical valve plug projecting downwardly from the bottom end of the pop-up stem and including a circumferential groove within which an annular seal ring is received. The valve plug and seal ring extend partially into the inlet port at the bottom of the sprinkler housing when water pressure is relatively low with the seal ring engaging a contoured valve seat bounding the inlet port. The seal ring is retained in sealing engagement with the valve seat by a biasing spring reacting between the pop-up stem and the sprinkler housing to urge the pop-up stem toward a normal position retracted into the sprinkler housing.

The valve seat comprises, in a preferred form, the inner diameter surface of an annular flange upstanding from a bottom wall of the sprinkler housing, particularly when the sprinkler housing is formed by conventional high production molding or casting processes. The annular flange is shaped to have a generally uniform cross-sectional thickness throughout at least a major portion of its height to insure substantially uniform cooling during solidification thereby providing a smooth valve seat substantially uninterrupted by heat deformation or distortion for positive sealing engagement with the seal ring. If desired, the valve seat may include a slight taper diverging toward the downstream end of the inlet port to facilitate aligned entry of the seal ring into sealing engagement therewith.

In operation, the relatively small valve plug and seal ring positively seal the sprinkler housing against inflow of water when the water pressure in a supply line is low to prevent water from draining or leaking through the sprinkler. Any pressure in the supply line acts against the small area of the valve plug resulting in a relatively small hydraulic force which, unless the pressure is relatively high, is insufficient to displace the valve plug against the force of the biasing spring. Such higher pressure is encountered when the water supply is turned fully on whereupon the valve plug is displaced from the valve seat to expose the comparatively larger cross-sectional area of the pop-up stem to the relatively high pressure. This results in a proportionately larger hydraulic force acting on the stem to drive the stem rapidly to the elevated spraying position and to hold the stem in that position until the pressure decreases sufficiently to permit the biasing spring to return the stem to the retracted position with the control valve sealing the inlet port.

Other features and advantates of the present invention will become more apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
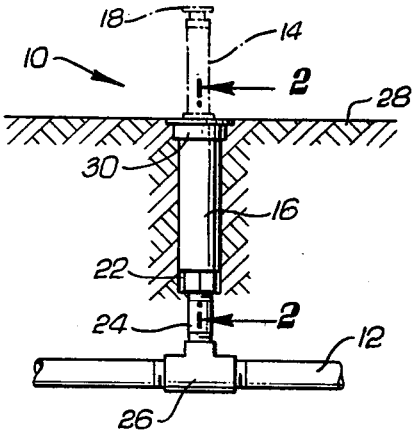
FIG. 1 is a fragmented side elevation view illustrating a pop-up sprinkler embodying the novel features of the invention coupled to a water supply line.

As illustrated in the exemplary drawings, a pop-up sprinkler referred to generally by the reference numeral 10 is connected to a water supply pipe 12, which may be installed underground, for receiving a flow of water under pressure from a suitable water supply (not shown). The sprinkler includes a pop-up stem 14 responsive to the pressure of the water for movement between a retracted position withdrawn substantially into a sprinkler housing 16 and an elevated spraying position projecting upwardly from the sprinkler housing 16, as illustrated in dotted lines in FIG. 1. In the elevated spraying position, a spray nozzle 18 at the upper end of the pop-up stem is positioned above surrounding vegetation for substantially unimpeded projection of a spray of water over a prescribed area for irrigation purposes.

Figure 2:
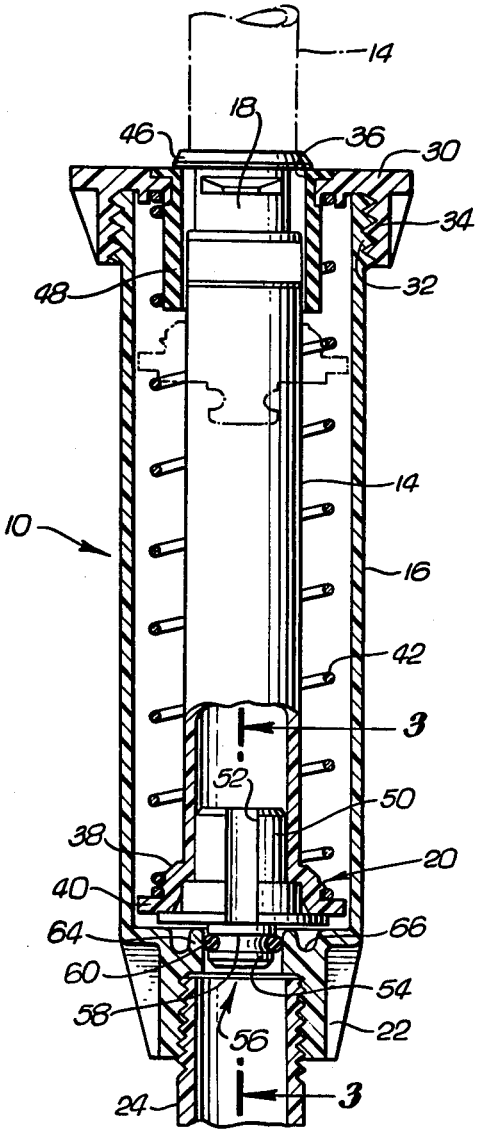
FIG. 2 is an enlarged vertical section taken generally on the line 2—2 of FIG. 1 with portions of the pop-up sprinkler illustrated in side elevation.
Figure 3:
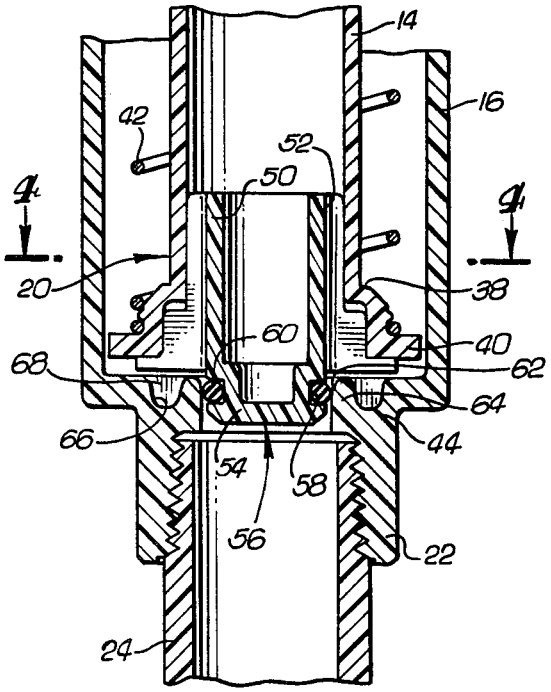
FIG. 3 is an enlarged fragmented vertical section of a portion of the pop-up sprinkler taken generally on the line 3—3 of FIG. 2.
Figure 4:
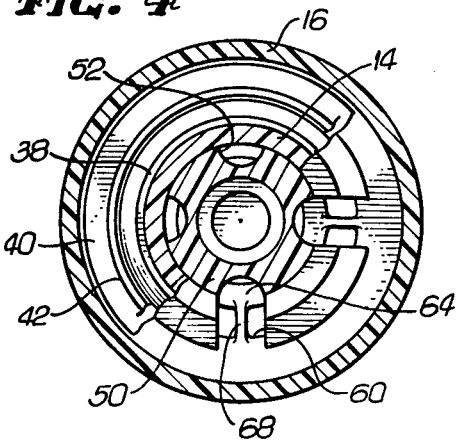
FIG. 4 is a horizontal section of the pop-up sprinkler taken generally on the line 4—4 of FIG. 3.

In accordance with the invention, the pop-up sprinkler 10 includes a relatively small control valve 20, shown in detail in FIGS. 2–4, for sealing the sprinkler housing against inflow of water from the supply line unless and until the water pressure reaches or exceeds a predetermined threshold pressure sufficient to move the pop-up stem 14 rapidly from the retracted position to the elevated spraying position. When the water pressure is below this predetermined threshold, the control valve 20 advantageously prevents leakage or drainage of water through the sprinkler housing 16 thereby preventing water waste in the form of localized flooding or overwatering of the soil immediately surrounding the upper end of the housing 16. In particular, when the water supply is turned off, water remaining within the supply line, which may be subjected to a relatively low pressure as a result of elevational variations in an irrigation system, is prevented from draining through the pop-up sprinkler to prevent water waste. Moreover, when the water supply is turned on and the supply line water pressure increases, flow through the sprinkler is still prevented until the pressure builds to a sufficient level to force the pop-up stem rapidly to the elevated spraying position, thereby minimizing the time required for the stem to reach the elevated spraying position to correspondingly minimize water leakage which inherently occurs during this movement.

As shown in detail in FIGS. 2–4, the exemplary pop-up sprinkler 10 includes the sprinkler housing 16 having a generally upright cylindrical shape with an inlet fitting 22 at its bottom end, which can be internally threaded as illustrated, for appropriate connection to a relatively short riser pipe 24 coupled in turn via a T-shaped fitting 26 (FIG. 1) to the water supply line 12. The sprinkler housing is constructed typically by a high production molding or casting process preferably from a relatively lightweight molded plastic or the like suitable for undergound installation with its upper end disposed substantially flush with the surface of the soil 28, as viewed in FIG. 1, although other materials, such as metal castings, can be used. The upper end of the housing 16 supports an annular cap 30 shown secured to the housing by interengaging sets of threads 32 and 34 and defining a central opening 36 through which the pop-up stem 14 is movable between the retracted position and the elevated spraying position.

The pop-up stem 14, which can also be formed from an injection molded plastic or the like, has a generally cylindrical shape for reception into the sprinkler housing 16 and to extend through the central opening 36 in the cap 30. The upper end of the pop-up stem 14 carries the spray nozzle 18, and the lower end of the stem is radially enlarged to include an upwardly presented shoulder 38 which is in turn surrounded by an annular ring 40. A helical compression spring 42 is positioned about the stem and reacts between the underside of the cap 30 and the upper side of the annular ring 40 to urge the stem 14 downwardly toward a position retracted substantially into the housing 16, as shown in full lines in FIGS. 2 and 3. In this retracted position, the lower end of the stem 14 is maintained in at least slightly spaced relation with a bottom wall 44 of the sprinkler housing 16 by a radially enlarged rim 46 on the spray nozzle 18 which engages the upper side of a guide sleeve 48 secured to the housing cap in a position lining the central opening 36. Accordingly, in the retracted position, the spray nozzle is withdrawn substantially into the guide sleeve 48 such that the spray nozzle is substantially flush with the upper end of the sprinkler housing 16 where it does not provide an obstacle to individuals or to passage of equipment such as mowers, sprayers, and the like.

The pop-up stem 14 is movable in response to the pressure of water in the water supply line 12 to the elevated spraying position with the spray nozzle 18 elevated above the housing cap 30 and surrounding vegetation. This movement occurs when the water pressure acting upon the underside of the pop-up stem 14 is sufficient to overcome the downward biasing force of the compression spring 42 thereby moving the pop-up stem upwardly within the sprinkler housing to a position projecting through the housing cap 30, as shown best in dotted lines in FIG. 2. In this elevated position, the shoulder 38 near the lower end of the stem 14 is held by the pressure in sealing engagement with the lower end of the guide sleeve 48 such that water flow is confined to upward passage through the hollow stem and projection outwardly through the spray nozzle 18.

In accordance with the invention, the control valve 20 is supported at the lower end of the pop-up stem 14 to seal the sprinkler housing against water inflow whenever the stem 14 is in the retracted position. The control valve 20 advantageously provides the required positive seal with a relatively inexpensive and simplified construction having a small cross-sectional area exposed to pressure whereby a relatively high water pressure is required to initiate upward movement of the stem. Once this upward motion begins, however, the relatively high pressure is effective to move the stem rapidly in a substantially snap-action motion to the elevated spraying position with the stem shoulder 38 held in sealing relation with the guide sleeve 48, thereby minimizing opportunity for water to leak between the stem and the sleeve during upward stem movement.

The control valve 20 comprises a cylindrical valve body 50 which can be formed from a lightweight and inexpensive molded plastic or the like to have a size and shape for reception into the lower end of the pop-up stem 14. The valve body 50 is secured to the stem for movement therewith by any suitable technique, such as a friction fit, an adhesive, welding, threading, or the like. Importantly, however, the valve body includes vertically extending recesses 52 spaced about its periphery for cooperating with the stem to define open channels for passage of water upwardly into the hollow stem and further to the spray nozzle 18.

The valve body 50 further includes a downwardly projecting central valve plug 54 of relatively small cross-sectional area for reception into a relatively small circular inlet port 56 at the lower end of the sprinkler housing 16 when the pop-up stem 14 is in the retracted position. This valve plug 54 has a length sufficient to include a circumferential groove 58 for receiving a relatively small seal ring 60, such as an O-ring, of a suitable resilient material.

When the pop-up stem 14 is in the retracted position, the seal ring 60 is disposed for positive sealing engagement with an annular valve seat 62 bounding the inlet port 56 in the sprinkler housing. This valve seat 62, in a preferred form of the invention, is defined by the inner diameter surface of a relatively short annular flange 64 of generally uniform cross-sectional thickness upstanding from the bottom wall 44 of the sprinkler housing 16. More particularly, in the illustrative embodiment, the flange 64 projects from the housing bottom wall 44 in an axially upward direction with respect to the inlet port and is surrounded by an annular recess 66 which may be interrupted at intervals by thin radial ribs 68 to increase the flange structural strength. This valve seat construction is particularly advantageous when the sprinkler housing is formed by conventional high production molding or casting techniques, since the substantially uniform thickness flange solidifies upon cooling at a substantially uniform rate to avoid or minimize heat deformation or distortion of the valve seat which could otherwise interfere with the desired positive seal with the seal ring 60.

In operation, the small valve plug 54 and the seal ring 60 prevent water flow into the sprinkler housing when the supply line water pressure is relatively low, such as when the water supply is turned off or when the water supply is on but the pressure is insufficient to move the pop-up stem rapidly to the elevated spraying position. This positive sealing relationship is maintained until the water pressure reaches a predetermined and relatively high threshold level, since the magnitude of the upwardly directed hydraulic force acting on the pop-up stem 14 is limited by the relatively small cross-sectional area of the valve plug. However, when the pressure at the inlet port reaches the predetermined relatively high level, the valve plug 54 is moved upwardly from the valve seat 62 to expose the comparatively larger cross-sectional area of the underside of the stem thereby resulting in a sudden and substantial increase in the hydraulic force acting on the stem to move the stem rapidly to the elevated spraying position.

The stem 14 is maintained in the elevated position until the water pressure in the supply line 12 is reduced to a level significantly less than the relatively high pressure required for movement to the elevated position. However, when this lower pressure is reached, the compression spring 42 returns the stem 14 to its retracted position. Since this pressure reduction typically occurs rapidly when the water supply is turned off, the stem 14 normally returns rapidly to the retracted position sealed against water inflow to minimize water leakage during the stem movement. Conveniently, to facilitate aligned return of the valve plug and seal ring into the inlet port, the valve seat may be tapered slightly to diverge in the upstream direction.

The pop-up sprinkler of this invention thus provides a relatively inexpensive and simple control valve construction responsive directly to the pressure of water supplied to the sprinkler. The control valve seals the sprinkler against entry of water unless the water pressure is sufficient to move the pop-up stem rapidly to the elevated spraying positon. With this construction, water waste arising from leakage or drainage through the sprinkler is significantly reduced.

A variety of modifications and improvements to the invention described herein are believed to be apparent to one skilled in the art. Accordingly, no limitation on the invention is intended, except by way of the appended claims.

I claim:

1. A pop-up sprinkler, comprising:

a sprinkler housing having a bottom end wall with a relatively small inlet port formed therein for flow of water into said housing, said sprinkler housing further including an annular flange surrounding said inlet port and upstanding from said bottom end wall with a substantially uniform cross-sectional thickness for at least a substantial portion of its height, the inner diameter surface of said flange defining an annular valve seat, said housing and said flange cooperating to define an upwardly open annular recess formed about the exterior of said flange;

a pop-up stem carried within said housing for movement between a retracted position withdrawn substantially into said housing and a spraying position projecting outwardly from said housing; and a control valve for preventing water flow into said housing when said stem is in the retracted position, said control valve including a relatively small valve plug carried by said stem and a seal ring carried by said valve plug for sealing engagement with said valve seat when said stem is in the retracted position.

2. The pop-up sprinkler of claim 1 wherein said control valve includes a valve body for connection to one end of said pop-up stem, said valve being supported by said valve body for at least partial reception into said upstanding annular flange when said stem is in the retracted position.

3. The pop-up sprinkler of claim 1 wherein said valve plug has a circumferential groove formed therein, said seal ring being receivable within said groove.

4. The pop-up sprinkler of claim 1 wherein said seal ring is formed from a resilient material.

5. The pop-up sprinkler of claim 1 including a plurality of relatively thin reinforcing ribs projecting radially through said recess between said flange and said end wall.

6. The pop-up sprinkler of claim 1 wherein said valve seat is formed to diverge at least slightly in a downstream direction with respect to water flow through said inlet port.

7. The pop-up sprinkler of claim 1 wherein said sprinkler housing is adapted for connection to a supply of water under pressure to said inlet port, said valve plug presenting a relatively small cross-sectional area exposed to pressure when said stem is in the retracted position whereby a relatively high pressure is required to displace said valve plug from a position with said seal ring in sealing engagement with said valve seat, said valve plug being displaced from said inlet port when said relatively high pressure is reached to expose to pressure the comparatively larger cross-sectional area of said stem thereby resulting in rapid movement of said stem to the spraying position.

8. The pop-up sprinkler of claim 1 including a spring for biasing said stem toward the retracted position.

9. A pop-up sprinkler, comprising:

a sprinkler housing having a bottom end wall with a relatively small inlet port formed therein for flow of water into said housing, said sprinkler housing further including an annular flange surrounding said inlet port and upstanding from said bottom end wall with a substantially uniform cross-sectional thickness for at least a substantial portion of its height, the inner diameter surface of said flange defining an annular valve seat, said sprinkler housing and said flange cooperating to define an upwardly open annular recess formed about the exterior of said flange and said sprinkler housing further including a plurality of relatively thin reinforcing ribs projecting radially through said recess between said flange and said end wall;

a pop-up stem carried within said housing for movement between a retracted position withdrawn substantially into said housing and a spraying position projecting outwardly from said housing; and a control valve for preventing water flow into said housing when said stem is in the retracted position, said control valve including a relatively small valve plug carried by said stem and a seal ring carried by said valve plug for sealing engagement with said valve seat when said stem is in the retracted position.

10. The pop-up sprinkler of claim 9 wherein said valve plug has a circumferential groove formed therein, said seal ring being receivable within said groove.

11. The pop-up sprinkler of claim 9 wherein said valve seat is formed to diverge at least slightly in a downstream direction with respect to water flow through said inlet port.

12. The pop-up sprinkler of claim 9 wherein said sprinkler housing is adapted for connection to a supply of water under pressure to said inlet port, said valve plug presenting a relatively small cross-sectional area exposed to pressure when said stem is in the retracted position whereby a relatively high pressure is required to displace said valve plug from a position with said seal ring in sealing engagement with said valve seat, said valve plug being displaced from said inlet port when said relatively high pressure is reached to expose to pressure the comparatively larger cross-sectional area of said stem thereby resulting in rapid movement of said stem to the spraying position.

13. A pop-up sprinkler, comprising: a generally cylindrical sprinkler housing having a bottom end wall with an inlet port formed therein for flow of water into said housing, said sprinkler housing further including an annular flange surrounding said inlet port and upstanding from said bottom end wall with a substantially uniform cross-sectional thickness for at least a substantial portion of its height, the inner diameter surface of said flange defining an annular valve seat;

a pop-up stem carried within said housing for movement between a retracted position withdrawn substantially into said housing and a spraying position projecting outwardly from said housing; and a control valve for preventing water flow into said housing when said stem is in the retracted position, said control valve including a relatively small valve plug carried by said stem and a seal ring carried by said valve plug for sealing engagement with said valve seat when said stem is in the retracted position.

14. The pop-up sprinkler of claim 13 wherein said control valve includes a valve body for connection to one end of said pop-up stem, said valve plug being supported by said valve body for at least partial reception into said upstanding annular flange when said stem is in the retracted position.

15. The pop-up sprinkler of claim 14 wherein said stem is hollow and carries a spray nozzle at its end opposite said control valve, said valve body defining water flow channels for passage of water upwardly from said inlet port into said stem when said seal ring is displaced from sealing engagement with said valve seat.

16. The pop-up sprinkler of claim 13 wherein said valve plug has a circumferential groove formed therein, said seal ring being receivable within said groove.

17. The pop-up sprinkler of claim 13 wherein said flange is defined by an upwardly open annular recess formed in said bottom end wall in radially spaced relation with said inlet port.

18. The pop-up sprinkler of claim 13 wherein said valve seat is formed to diverge at least slightly in a downstream direction with respect to water flow through said inlet port.

19. The pop-up sprinkler of claim 13 wherein said sprinkler housing is adapted for connection to a supply of water under pressure to said inlet port, said valve plug presenting a relatively small cross-sectional area exposed to pressure when said stem is in the retracted position whereby a relatively high pressure is required to displace said valve plug from a position with said seal ring in sealing engagement with said valve seat, said valve plug being displaced from said inlet port when said relatively high pressure is reached to expose to pressure the comparatively larger cross-sectional area of said stem thereby resulting in rapid movement of said stem to the spraying position.

20. The pop-up sprinkler of claim 13 including a spring for biasing said stem toward the retracted position.

21. The pop-up sprinkler of claim 13 wherein said bottom end wall and said flange of said sprinkler housing have a one-piece construction.

* * * * *